US006565060B2

(12) United States Patent
Li et al.

(10) Patent No.: US 6,565,060 B2
(45) Date of Patent: May 20, 2003

(54) ATTACHMENT STAND FRAME FOR SPA UMBRELLA

(76) Inventors: Wanda Yiing Li, 2 Flagstone #642, Irvine, CA (US) 92606; Raymond J. Carabotta, 3466 N. Miami Ave., Miami, FL (US) 33127

( * ) Notice: Subject to any disclaimer, the term of this patent is extended or adjusted under 35 U.S.C. 154(b) by 0 days.

(21) Appl. No.: 09/793,268

(22) Filed: Feb. 27, 2001

(65) Prior Publication Data

US 2002/0117594 A1 Aug. 29, 2002

(51) Int. Cl.[7] ..... F16M 11/00

(52) U.S. Cl. ..... 248/522; 248/910; 248/292.12; 248/418; 248/349.1

(58) Field of Search ..... 248/522, 289.11, 248/292.12, 292.13, 910, 349.1, 418; 135/15.1, 98; 70/190; 74/529, 507, 535, 536, 530

(56) References Cited

U.S. PATENT DOCUMENTS

| | | | | | |
|---|---|---|---|---|---|
| 3,455,531 | A | * | 7/1969 | Baker | 248/349.1 |
| 5,002,081 | A | * | 3/1991 | Stromeyer | 135/21 |
| 5,765,582 | A | * | 6/1998 | Molnar | 135/16 |
| 5,826,850 | A | * | 10/1998 | Goldsmith | 108/150 |
| 5,893,547 | A | * | 4/1999 | Cohen, Jr. | 248/521 |
| 5,918,849 | A | * | 7/1999 | Bliss | 192/223.1 |
| D414,053 | S | * | 9/1999 | Ordelman | D6/416 |
| 6,089,246 | A | * | 7/2000 | Barnes | 135/117 |
| 6,321,763 | B1 | * | 11/2001 | Ma | 135/20.1 |

OTHER PUBLICATIONS

Reference on Spa Umbrellas by FIM Manufacturing Inc., Copyright 1999 as shown on last page, (5 pages in total), shows the spa mount base.*

United States Patent Application Publication 2001/0040208A1, inventor Wanda Ying Li.*

United States Patent Application Publication 2001/0032916A1, inventor Dennis B. Wess.*

Reference on Spa Umbrellas by Raytech Inc., Copyright 2001 as shown on last page, (4 pages in total), shows a spa mount base with lever.*

* cited by examiner

*Primary Examiner*—Korie Chan
*Assistant Examiner*—Ingrid Weinhold
(74) *Attorney, Agent, or Firm*—Raymond Y. Chan; David and Raymond Patent Group

(57) ABSTRACT

An attachment stand frame for spa umbrella which includes a shaft supporting an awning thereon, wherein the attachment stand frame includes a stand base including a reinforcing panel extended therefrom adapted for mounting underneath an outdoor spa wherein the spa umbrella is uprightly supported on the stand base, and a supporting frame perpendicularly extended from the stand base for substantially attaching to the outdoor spa so as to securely mount the spa umbrella to the outdoor spa. The attachment stand frame further includes a base body, having a receiving chamber provided thereon, adapted to support the shaft, a rotor, which is rotatably disposed in the receiving chamber, having a rotor axial socket for inserting the shaft thereinto, and a locking arrangement for locking up the rotation movement of the rotor. Therefore, the attachment stand frame is adapted to be rigidly supported by the outdoor spa and rotatably mount the spa umbrella.

16 Claims, 4 Drawing Sheets

ATTACHMENT STAND FRAME FOR SPA UMBRELLA

BACKGROUND OF THE PRESENT INVENTION

1. Field of Invention

The present invention relates to an outdoor umbrella, and more particularly to an attachment stand frame for spa umbrella, wherein the attachment stand frame is adapted for easily attaching to and detaching from an existing spa without altering the original structure thereof.

2. Description of Related Arts

Under strong pressure of daily work, most people like to take a spa for relieving stress. They normally build a spa in their bathroom so that they can enjoy the spa everyday. However, some people enjoy taking the spa in a natural environment such that they may purchase an outdoor spa that can be placed in their yard.

However, one of the major drawbacks of the outdoor spa is that the sunlight may directly irritate a user while he or she is taking the spa. So, the user may usually purchase an outdoor umbrella for shading the sunlight. Since the sunlight shines in different directions within a day, it is unreasonable for the user to move the entire outdoor umbrella back and forth to obtain the optimum shading area of the outdoor umbrella. Thus, due to the heavy weight of the outdoor umbrella, which is approximately 50 to 60 pounds, the user especially woman, always has difficulty moving the outdoor umbrella. For easily moving, the outdoor umbrella may be reduced in weight so that the user may merely reposition the outdoor umbrella with less effort. However, when a gusty wind hits on outdoor umbrella, the unstable outdoor umbrella may fall down easily and hit any object around it, especially a young child, so as to cause an unwanted injury to the young child.

SUMMARY OF THE PRESENT INVENTION

A main object of the present invention is to provide an attachment stand frame for spa umbrella wherein the attachment stand frame is adapted for detachably attaching to a spa body easily so as to provide an optimum shading area by an awning of the spa umbrella.

Another object of the present invention is to provide an attachment stand frame for a spa umbrella wherein attachment stand frame, comprised of lightweight but sturdy structure, adequately supports the spa umbrella. In other words, the spa umbrella can be reduced its overall weight for easy carriage.

Another object of the present invention is to provide an attachment stand frame for a spa umbrella wherein a shaft of the spa umbrella is adapted to be rigidly supported on the attachment stand frame and selectively rotated so as to provide an optimum shading area by an awning of the spa umbrella.

Another object of the present invention is to provide an attachment stand frame for a spa umbrella wherein the attachment stand frame is adapted for installing into an existing outdoor spa without altering the original structure of the spa.

Accordingly, in order to accomplish the above objects, the present invention provides an attachment stand frame for a spa umbrella which comprises a shaft supporting an awning thereon, wherein the attachment stand frame comprises:

a stand base comprising a reinforcing panel extended therefrom adapted for mounting underneath a spa wherein the spa umbrella is uprightly supported on the stand base; and a supporting frame perpendicularly extended from the stand base for substantially attaching to the spa so as to securely mount the spa umbrella to the spa.

DETAILED DESCRIPTION OF THE PREFERRED EMBODIMENT

Figure 1:
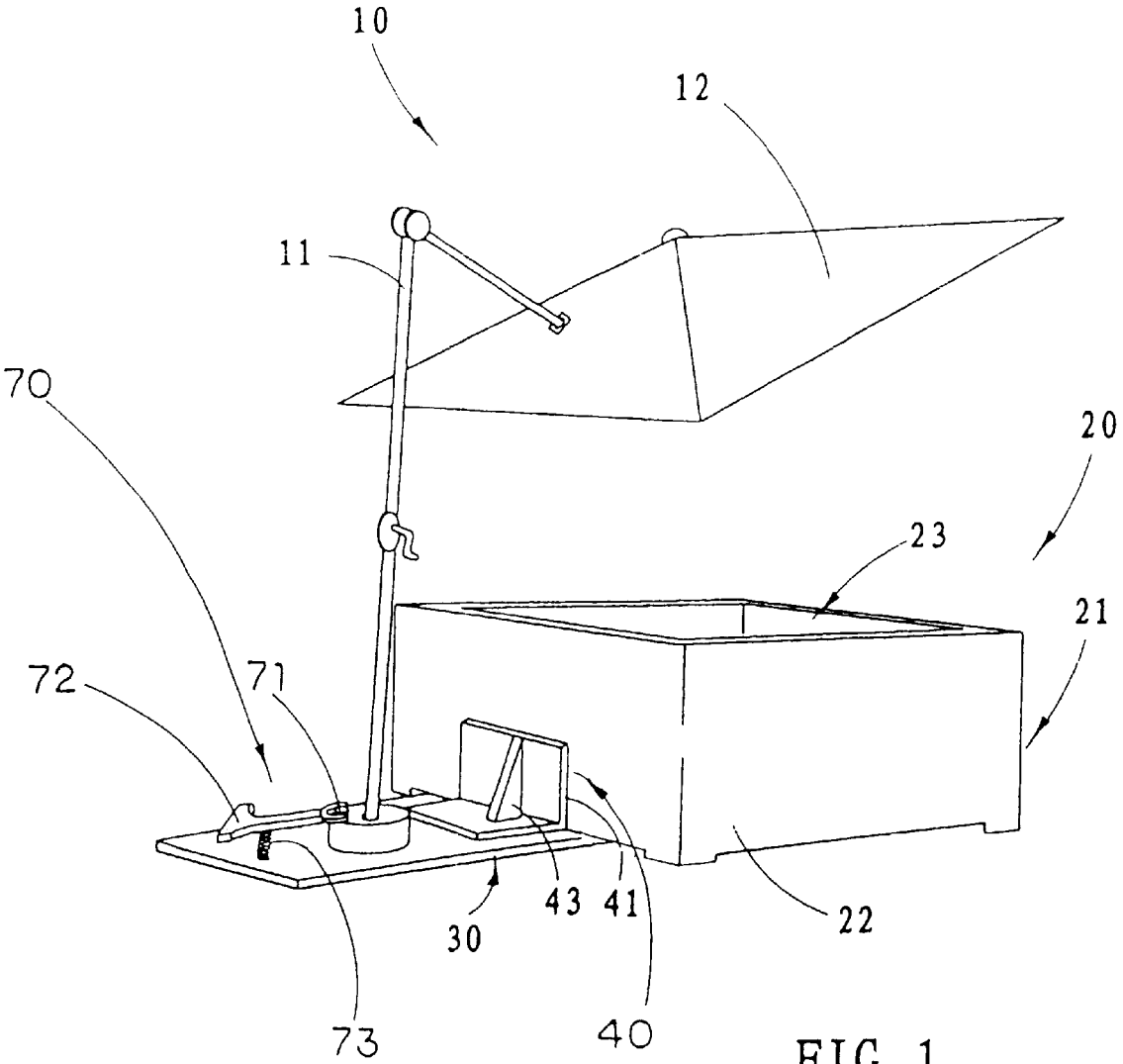
FIG. 1 is a perspective view of an attachment stand frame for spa umbrella according to a preferred embodiment of the present invention.

Referring to FIG. 1 of the drawings, an attachment stand frame for spa umbrella according to a preferred embodiment of the present invention, wherein the attachment stand is constructed for rigidly supporting a spa umbrella 10 thereon and substantially mounting the spa umbrella 10 to an outdoor spa 20 so as to prevent an unwanted movement of the spa umbrella.

The spa umbrella 10, such as a conventional outdoor umbrella, comprises a shaft 11 supporting an awning 12 thereon, wherein the awning 12 is arranged to be rotatably driven by the shaft 11 so as to provide a shading area.

The outdoor spa 20 comprises a spa body 21 having a surrounding wall 22 perpendicularly extended therefrom and defining a liquid compartment 23 in the spa body 21. The spa body 21 can be constructed in circular shape wherein the surrounding wall 22 is formed at a circumference of the spa body 21. Or, the spa body can be formed in rectangular shape wherein the rectangular surrounding wall 22 is upwardly extended to define the liquid compartment 23 within the rectangular surrounding wall 22.

According to the preferred embodiment, the attachment stand frame comprises a stand base 30, a reinforcing panel 31 extended therefrom adapted for mounting underneath the outdoor spa 20 wherein the spa umbrella 10 is uprightly supported on the stand base 30, and a supporting frame 40 perpendicularly extended from the stand base 30 for substantially attaching to the outdoor spa 20 so as to securely mount the spa umbrella 10 to the outdoor spa 20.

Figure 2:
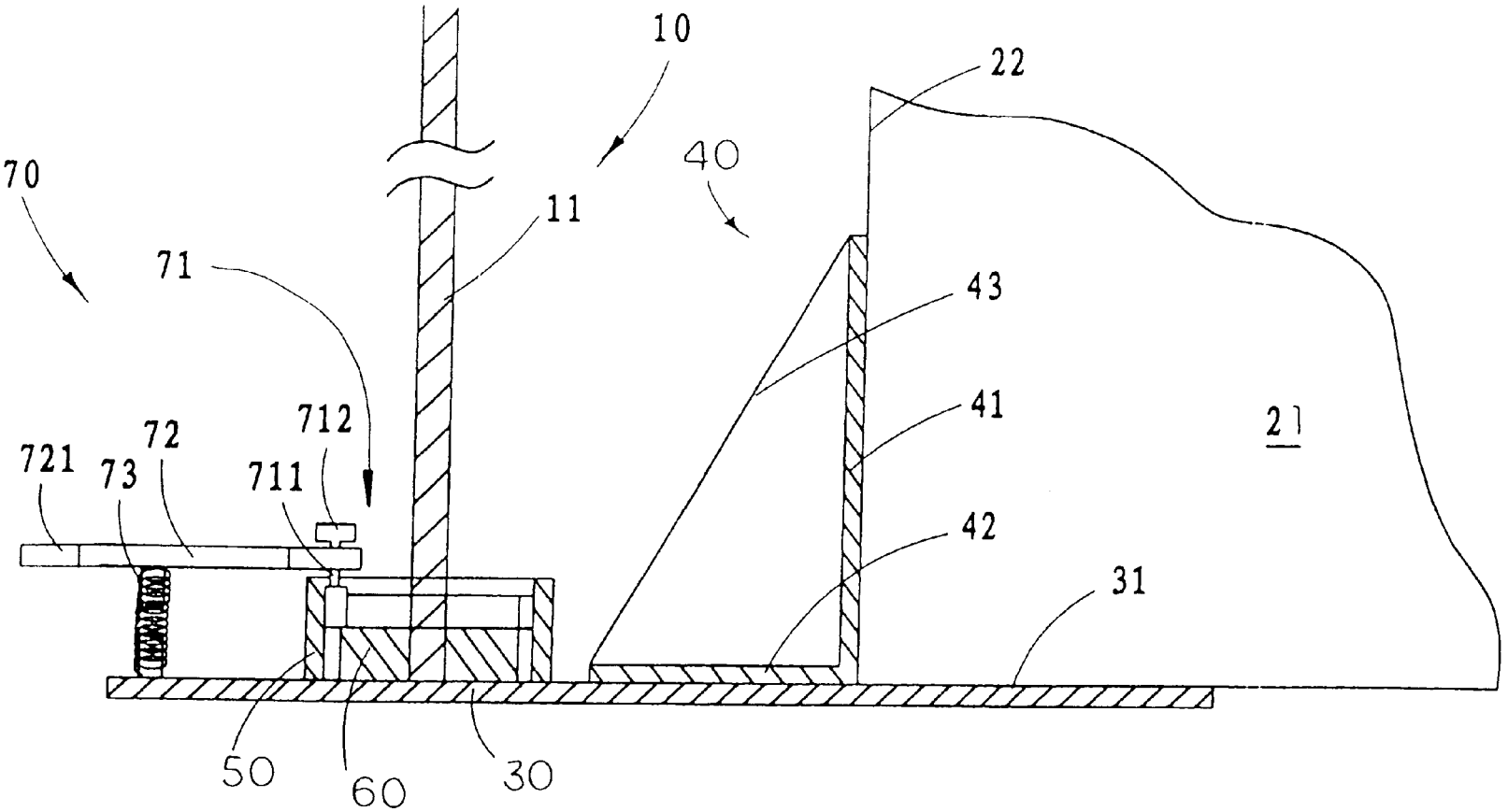
FIG. 2 is a sectional view of the attachment stand frame for spa umbrella according to the above preferred embodiment of the present invention.

As shown in FIG. 2, the reinforcement panel 31 is integrally extended from the stand base 30 wherein the reinforcement panel 31, having a predetermined thickness, is adapted for mounting on a bottom of the spa body 21 of the outdoor spa 20 so as to support the spa umbrella 10 in a stable manner. Due to the weight of the outdoor spa 20, the stand base 30 is depressed by the spa body 21 and the attachment stand frame is securely mounted on the outdoor spa 20 so as to prevent a vertical movement of the spa umbrella 10.

The supporting frame 40 having a L-shaped comprises a vertical panel 41 fittedly attached on the surrounding wall 22 of the outdoor spa 20 and a horizontal panel 42 mounted on the stand base 30 in such a manner that the supporting frame 40 is rigidly supported on the outdoor spa 20 so as to prevent any lateral movement of the spa umbrella 10. In other words, when the attachment stand frame is installed to the outdoor spa 20, the spa umbrella 10 is substantially supported by the outdoor spa 20 so as to prevent any movement of the spa umbrella 10 even when an external force is exerted on the spa umbrella 10, such as wind blow.

The supporting frame 40 further comprises a supporting arm 43 inclinedly supported between the vertical panel 41 and horizontal panel 42 so as to form a secure triangular structure for supporting the spa umbrella 10. The triangular shaped supporting arm 43 has a vertical edge portion 431 perpendicularly mounted on the vertical panel 41 and a horizontal edge portion 432 perpendicularly mounted on the horizontal panel 42 of the supporting frame 40 so as to enhance the rigid triangular structure of the attachment stand frame of the present invention.

Figure 3:
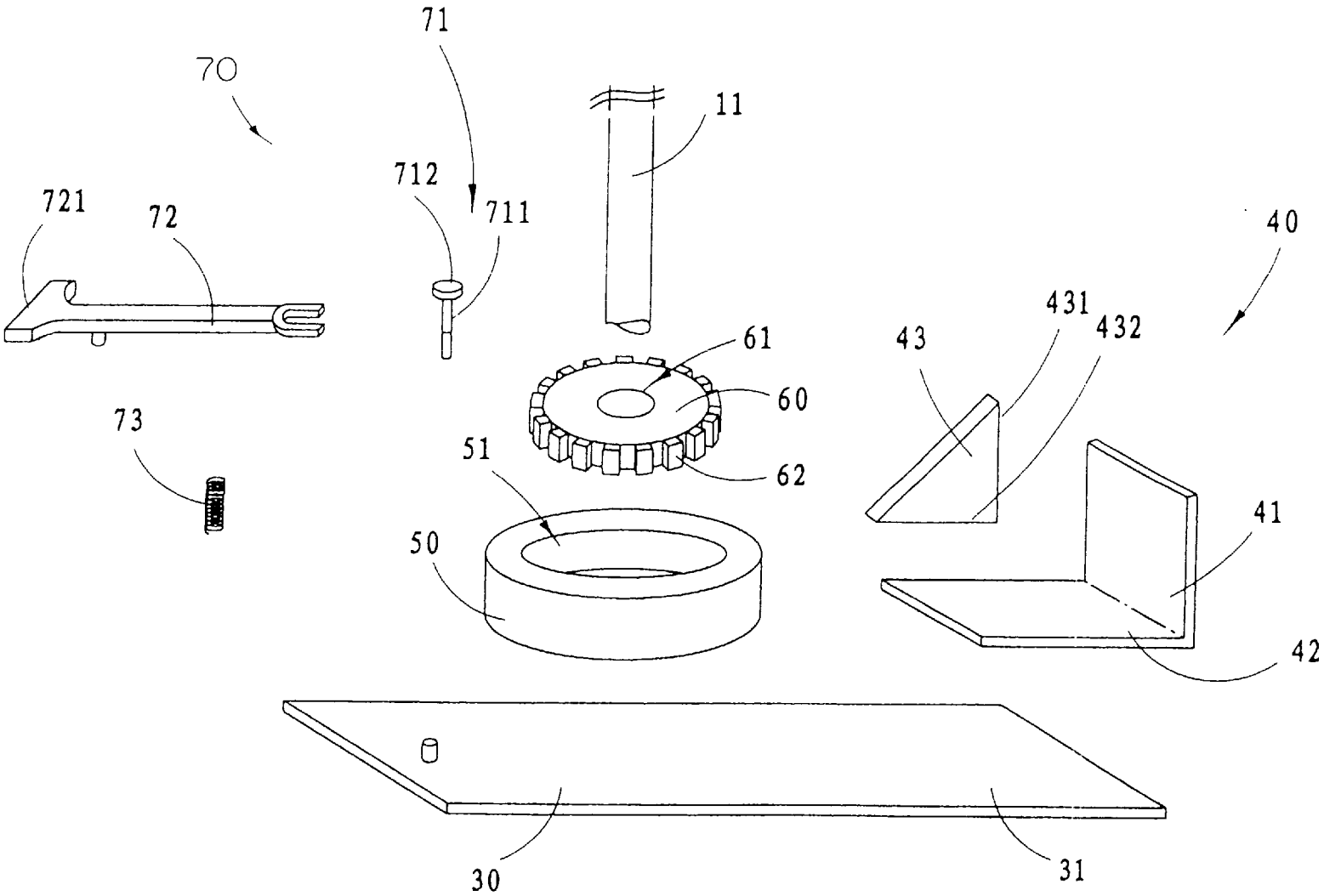
FIG. 3 is an exploded perspective view of the attachment stand frame for spa umbrella according to the above preferred embodiment of the present invention.

As shown in FIG. 3, the attachment stand frame further comprises a base body 50, which is integrally mounted on the stand base 30, having a receiving chamber 51 for uprightly supporting the shaft 11 thereon; a rotor 60, which is rotatably disposed in the receiving chamber 51 of the base body 50, having a rotor axial socket 61 for fittedly inserting the shaft 11 thereinto; and a locking arrangement 70 for locking up the shaft 11 on the rotor 60 in a rotatably movable manner.

The locking arrangement 70 comprises a locking member 71 extended into the receiving chamber 51 for engaging with the rotor 60, a driving lever 72 arranged to drive the locking member 71 to move between a locking position and an unlocked position, and a resilient element 73 for applying urging pressure against the driving lever 72 so as to normally retain the locking member 71 at the locking position. At the locking position, the locking member 71 is engaged with the rotor 60 so as to lock up the rotor 60 from being rotated. At the unlocked position, the locking member 71 is moved away from the rotor 60 so as to disengage with the rotor 60 such that the rotor 60 is capable of being rotated to turn the shaft 11.

The locking member 71 comprises a locking latch 711 extended into the receiving chamber 51 in a vertical movable manner and an enlarged head button 712 vertically extended from the locking latch 711 to outside, wherein the locking latch 711 is adapted for blocking the rotor 60 in a rotatably movable manner, so as to lock up the rotation of the shaft 11.

The driving lever 72 is pivotally mounted on the base body 50 wherein one engaging end of the driving lever 72, having a Y-shaped, is engaged with the locking latch 711 of the locking member 72 while another end of the driving lever 71 has an enlarged step board 721 mounted thereto in such a manner that, when a downward force is applied on the step board 721, the locking member 71 is driven to move upwardly to disengage with the rotor 60. In other words, the locking latch 711 is arranged to be driven by the driving lever 72 to move from a normal locking position to an unlocked position.

The resilient element 73 is adapted for applying an urging pressure against the driving lever 72 so as to normally retain the locking member 71 at the locking position. At the locking position, the locking latch 711 of the locking member 71 is extended to the rotor 60 for blocking up the rotor 60 from being rotated in the receiving chamber 51, so as to lock up the rotation of the shaft 11. At the unlocked position, the locking latch 711 of the locking member 71 is vertically moved away from the rotor 60 so as to release the blocking up of the rotor 60, so that the rotor 60 is capable of being rotated to turn the shaft 11.

Accordingly, the resilient element 73 is a coil spring having two ends biasing against the driving lever 72 and the base body 50 so as to normally urge and retain the locking member 71 in a lower position that the locking member 71 is extended to the rotor 60 to block the rotor 60 from being rotated.

Moreover, the rotor 60 comprises a plurality of engaging teeth 62 evenly formed on an outer circumference of the rotor 60 for selectively engaging with the locking member 71, so as to ensure the engagement between the rotor 60 and the locking member 71. In other words, when the locking latch 711 of the locking member 71 is engaged with the engaging teeth 62 of the rotor 60, the rotor 60 is blocked in a rotatably movable manner so as to lock up the rotation of the shaft 11.

In order to mount the attachment stand frame to the outdoor spa 20 for supporting spa umbrella 10, the spa body 21 of the outdoor spa 20 must be placed on top of the reinforcing panel 31 of the stand base 30 wherein the vertical panel 41 of the supporting frame 40 is pressed against the surrounding wall 22 of the outdoor spa 20 in such a manner that the attachment stand frame is securely attached to the outdoor spa 20 and rigidly supports the spa umbrella 20.

Figure 4:
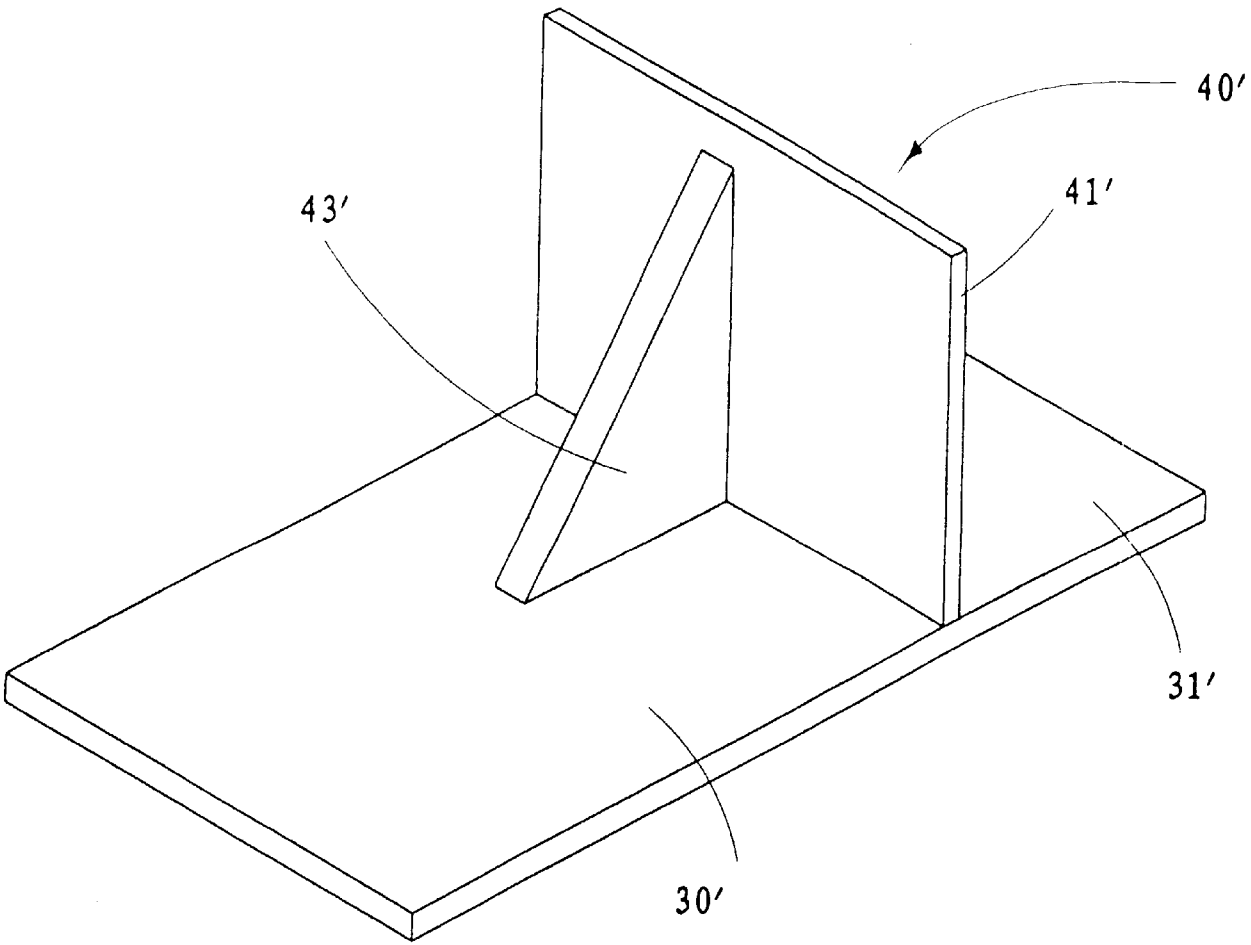
FIG. 4 illustrates an alternative mode of the supporting frame of the attachment stand frame for spa umbrella according to the above preferred embodiment of the present invention.

FIG. 4 illustrates an alternative mode of the supporting frame 40' according to the above preferred embodiment of the present invention, wherein the vertical panel 41' and the supporting arm 43' are upwardly extended between the stand base 30' and the reinforcing panel 31' for rigidly attaching on the surrounding wall 22 of the outdoor spa 20.

What is claimed is:

1. A spa umbrella for an outdoor spa which comprises a spa body having a surrounding wall perpendicularly extended from a bottom to define a liquid compartment therein, wherein the spa umbrella comprises:

a shaft supporting an awning which is arranged to be rotatably driven by the shaft so as to provide a shading area covering the spa body;

an attachment stand frame, comprising:

a stand base wherein the spa umbrella is uprightly supported on the stand base, a reinforcing panel which is extended from the stand base for mounting underneath the outdoor spa for mounting on the bottom of the spa body of the outdoor spa so as to support the spa umbrella on the stand base in a stable manner, and a supporting frame which is perpendicularly extended from the stand base for attaching to the surrounding wall of the spa body, wherein the supporting frame is rigidly supported on the outdoor spa for securely mounting the spa umbrella to the outdoor spa so as to prevent any lateral movement of the spa umbrella;

a base body, which is integrally mounted on the stand base, having a receiving chamber to uprightly support the shaft thereon;

a rotor, which is rotatably disposed in the receiving chamber of the base body, having a rotor axial socket for fittedly inserting the shaft thereinto; and a locking arrangement for locking up the shaft on the rotor in a rotatably movable manner, wherein the locking arrangement comprises:

a locking member extended into the receiving chamber for engaging with the rotor, a driving lever arranged to drive the locking member to move between a locking position and an unlocked position, and a resilient element for applying urging pressure against the driving lever so as to retain the locking member at the locking position, wherein at the locking position, the locking member is engaged with the rotor so as to lock up the rotor from being rotated, and at the unlocked position, the locking member is moved away from the rotor so as to disengage with the rotor so that the rotor is capable of being rotated to turn the shaft;

wherein the supporting frame comprises a vertical panel upwardly extended from the stand base for fittedly attaching on the surrounding wall of the spa body of the outdoor spa, a horizontal panel mounted on the stand base, and a supporting arm mounted between the vertical panel and the horizontal panel, wherein the supporting arm has a vertical edge portion perpendicularly mounted on the vertical panel and a horizontal edge portion perpendicularly mounted on the horizontal panel so as to form a secure triangular structure for supporting the spa umbrella.

2. The spa umbrella, as recited in claim 1, wherein the locking member comprises a locking latch extended into the receiving chamber in a vertical manner and an enlarged head button vertically extended from the locking latch to outside, wherein the locking latch is adapted for blocking the rotor in a rotatably movable manner so as to lock up a rotation of the shaft.

3. The spa umbrella, as recited in claim 2, wherein the driving lever, which is pivotally mounted on the base body, having a first end engaged with the locking latch of the locking member and a second end having an enlarged step board mounted thereto in such a manner that, when a downward force is applied on the step board, the locking member is driven to move upwardly to disengage with the rotor, so that the locking latch is arranged to be driven by the driving lever to move from the locking position to the unlock position.

4. The spa umbrella, as recited in claim 3, wherein the resilient element is a coil spring having two ends biasing against the driving lever and the base body so as to normally urge and retain the locking member in the locking position that the locking latch is extended to the rotor to block the rotor from being rotated.

5. The spa umbrella, as recited in claim 1, wherein the rotor comprises a plurality of engaging teeth evenly formed on an outer circumference thereof for selectively engaging with the locking member, so as to ensure an engagement between the rotor and the locking member, so that when the locking member is engaged with the engaging teeth of the rotor, the rotor is blocked for any rotation.

6. The spa umbrella, as recited in claim 4, wherein the rotor comprises a plurality of engaging teeth evenly formed on an outer circumference thereof for selectively engaging with the locking latch, so as to ensure an engagement between the rotor and the locking latch, so that when the locking latch is engaged with the engaging teeth of the rotor, the rotor is blocked for any rotation.

7. A spa umbrella for an outdoor spa which comprises a spa body having a surrounding wall perpendicularly extended from a bottom to define a liquid compartment therein, wherein the spa umbrella comprises:

a shaft supporting an awning which is arranged to be rotatably driven by the shaft so as to provide a shading area covering the spa body;

an attachment stand frame, comprising:

a stand base wherein the spa umbrella is uprightly supported on the stand base, a reinforcing panel which is extended from the stand base for mounting underneath the outdoor spa for mounting on the bottom of the spa body of the outdoor spa so as to support the spa umbrella on the stand base in a stable manner, and a supporting frame which is perpendicularly extended from the stand base for attaching to the surrounding wall of the spa body, wherein the supporting frame is rigidly supported on the outdoor spa for securely mounting the spa umbrella to the outdoor spa so as to prevent any lateral movement of the spa umbrella;

a base body, which is integrally mounted on the stand base, having a receiving chamber to uprightly support the shaft thereon;

a rotor, which is rotatably disposed in the receiving chamber of the base body, having a rotor axial socket for fittedly inserting the shaft thereinto; and a locking arrangement for locking up the shaft on the rotor in a rotatably movable manner, wherein the locking arrangement comprises:

a locking member extended into the receiving chamber for engaging with the rotor, a driving lever arranged to drive the locking member to move between a locking position and an unlocked position, and a resilient element for applying urging pressure against the driving lever, so as to retain the locking member at the locking position, wherein at the locking position, the locking member is engaged with the rotor so as to lock up the rotor from being rotated, and at the unlocked position, the locking member is moved away from the rotor so as to disengage with the rotor so that the rotor is capable of being rotated to turn the shaft;

wherein the locking member comprises a locking latch extended into the receiving chamber in a vertical manner and an enlarged head button vertically extended from the locking latch to outside, wherein the locking latch is adapted for blocking the rotor in a rotatably movable manner so as to lock up a rotation of the shaft.

8. The spa umbrella, as recited in claim 7, wherein the driving lever, which is pivotally mounted on the base body, having a first end engaged with the locking latch of the locking member and a second end having an enlarged step board mounted thereto in such a manner that, when a downward force is applied on the step board, the locking member is driven to move upwardly to disengage with the rotor, so that the locking latch is arranged to be driven by the driving lever to move from the locking position to the unlock position.

9. The spa umbrella, as recited in claim 8, wherein the resilient element is a coil spring having two ends biasing against the driving lever and the base body so as to normally urge and retain the locking member in the locking position that the locking latch is extended to the rotor to block the rotor from being rotated.

10. The spa umbrella, as recited in claim 7, wherein the rotor comprises a plurality of engaging teeth evenly formed on an outer circumference thereof for selectively engaging with the locking latch, so as to ensure an engagement between the rotor and the locking latch, so that when the locking latch is engaged with the engaging teeth of the rotor, the rotor is blocked for any rotation.

11. The spa umbrella, as recited in claim 8, wherein the rotor comprises a plurality of engaging teeth evenly formed on an outer circumference thereof for selectively engaging with the locking latch, so as to ensure an engagement between the rotor and the locking latch, so that when the locking latch is engaged with the engaging teeth of the rotor, the rotor is blocked for any rotation.

12. The spa umbrella, as recited in claim 9, wherein the rotor comprises a plurality of engaging teeth evenly formed on an outer circumference thereof for selectively engaging with the locking latch, so as to ensure an engagement between the rotor and the locking latch, so that when the locking latch is engaged with the engaging teeth of the rotor, the rotor is blocked for any rotation.

13. A spa umbrella for an outdoor spa which comprises a spa body having a surrounding wall perpendicularly extended from a bottom to define a liquid compartment therein, wherein the spa umbrella comprises:

a shaft supporting an awning which is arranged to be rotatably driven by the shaft so as to provide a shading area covering the spa body;

an attachment stand frame, comprising:

a stand base wherein the spa umbrella is uprightly supported on the stand base, a reinforcing panel which is extended from the stand base for mounting underneath the outdoor spa for mounting on the bottom of the spa body of the outdoor spa so as to support the spa umbrella on the stand base in a stable manner, and a supporting frame which is perpendicularly extended from the stand base for attaching to the surrounding wall of the spa body, wherein the supporting frame is rigidly supported onthe outdoor spa for securely mounting the spa umbrella to the outdoor spa so as to prevent any lateral movement of the spa umbrella;

a base body, which is integrally mounted on the stand base, having a receiving chamber to uprightly support the shaft thereon;

a rotor, which is rotatably disposed in the receiving chamber of the base body, having a rotor axial socket for fittedly inserting the shaft thereinto; and a locking arrangement for locking up the shaft on the rotor in a rotatably movable manner, wherein the locking arrangement comprises:

a locking member extended into the receiving chamber for engaging with the rotor, a driving lever arranged to drive the locking member to move between a locking position and an unlocked position, and a resilient element for applying urging pressure against the driving lever so as to retain the locking member at the locking position, wherein at the locking position, the locking member is engaged with the rotor so as to lock up the rotor from being rotated, and at the unlocked position, the locking member is moved away from the rotor so as to disengage with the rotor so that the rotor is capable of being rotated to turn the shaft;

wherein the supporting frame comprises a vertical panel upwardly extended from the stand base for fittedly attaching on the surrounding wall of the spa body of the outdoor spa and a supporting arm mounted between the vertical panel and the stand base, wherein the supporting arm has a vertical edge portion perpendicularly mounted on the vertical panel and a horizontal edge portion perpendicularly mounted on the stand base so as to form a secure triangular structure for supporting the spa umbrella;

wherein the locking member comprises a locking latch extended into the receiving chamber in a vertical manner and an enlarged head button vertically extended from the locking latch to outside, wherein the locking latch is adapted for blocking the rotor in a rotatably movable manner so as to lock up a rotation of the shaft.

14. The spa umbrella, as recited in claim 13, wherein the driving lever, which is pivotally mounted on the base body, having a first end engaged with the locking latch of the locking member and a second end having an enlarged step board mounted thereto in such a manner that, when a downward force is applied on the step board, the locking member is driven to move upwardly to disengage with the rotor, so that the locking latch is arranged to be driven by the driving lever to move from the locking position to the unlock position.

15. The spa umbrella, as recited in claim 14, wherein the resilient element is a coil spring having two ends biasing against the driving lever and the base body so as to normally urge and retain the locking member in the locking position that the locking latch is extended to the rotor to block the rotor from being rotated.

16. The spa umbrella, as recited in claim 15, wherein the rotor comprises a plurality of engaging teeth evenly formed on an outer circumference thereof for selectively engaging with the locking latch, so as to ensure an engagement between the rotor and the locking latch, so that when the locking latch is engaged with the engaging teeth of the rotor, the rotor is blocked for any rotation.

* * * * *